US006467883B1

(12) United States Patent
Sakurai

(10) Patent No.: US 6,467,883 B1
(45) Date of Patent: Oct. 22, 2002

(54) PRINTHEAD, PRINTING APPARATUS USING THE SAME, AND PRINTHEAD CONTROL METHOD

(75) Inventor: Masataka Sakurai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/640,064

(22) Filed: Aug. 17, 2000

(30) Foreign Application Priority Data

Aug. 24, 1999 (JP) ..... 11-237527

(51) Int. Cl.[7] ..... B41J 2/05
(52) U.S. Cl. ..... 347/56; 347/57
(58) Field of Search ..... 347/11, 12, 13, 347/56–59

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/56 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,128 A | | 2/1988 | Endo et al. | 347/56 |
| 4,740,796 A | | 4/1988 | Endo et al. | 347/56 |
| 5,519,416 A | * | 5/1996 | Hayasaki et al. | 347/13 |

FOREIGN PATENT DOCUMENTS

| | | | |
|---|---|---|---|
| JP | 59-123670 | 7/1984 | B41J/3/04 |
| JP | 59-138461 | 8/1984 | B41J/3/04 |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

Disclosed is a printhead capable of outputting information about the state of the printhead at a proper speed while increasing the printing data input speed. In a printing data transfer/discharge sequence of supplying clock signals CLK having a first frequency and a second frequency lower than the first frequency from a printing apparatus main body, and inputting printing data DATA which influences an increase in printing speed, printing data is transferred in synchronism with a first clock signal. In a data read sequence of outputting information MEM_OUT and TMP_OUT about the state of the printhead after the printing data input period, information is output in synchronism with a second clock signal.

22 Claims, 14 Drawing Sheets

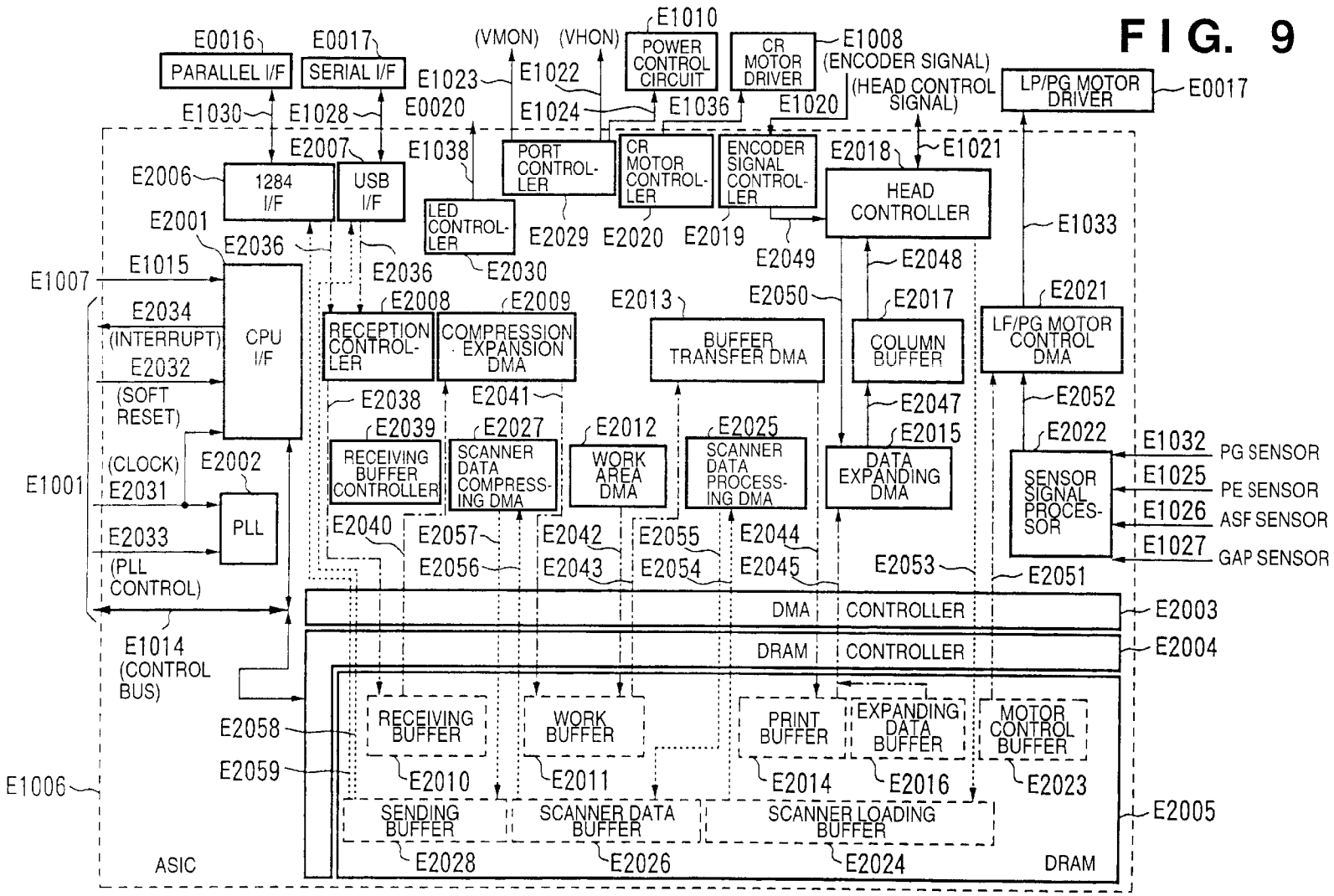
FIG. 9
LP/PG MOTOR DRIVER
E0017
E1032
E1025
E1026
E1027
PG SENSOR
PE SENSOR
ASF SENSOR
GAP SENSOR
E2003
E2004
E2005
E1033
E2021
LF/PG MOTOR CONTROL DMA
E2052
E2022
SENSOR SIGNAL PROCESSOR
E2051
CONTROLLER
CONTROLLER
MOTOR CONTROL BUFFER
E2023
DRAM
E1021
HEAD CONTROLLER
E2048
E2017
COLUMN BUFFER
E2047
E2015
DATA EXPANDING DMA
E2053
E1008 (ENCODER SIGNAL)
(HEAD CONTROL SIGNAL)
E2018
E1020
CR MOTOR DRIVER
ENCODER SIGNAL CONTROL-LER
E2049
E2050
BUFFER TRANSFER DMA
E2025
SCANNER DATA PROCESS-ING DMA
E2044
E2045
DMA
DRAM
EXPANDING DATA BUFFER
E2016
PRINT BUFFER
E2014
SCANNER LOADING BUFFER
E2024
E1010
POWER CONTROL CIRCUIT
E1036
CR MOTOR CONTROL-LER
E2019
E2020
E2013
E2055
E2054
E2012
WORK AREA DMA
(VHON)
(VMON)
E1022
E1024
PORT CONTROL-LER
E2029
E2030
E2009
COMPRESSION EXPANSION DMA
E2041
E2027
SCANNER DATA COMPRESS-ING DMA
E2042
E2043
WORK BUFFER
E2011
SCANNER DATA BUFFER
E2026
E1023
E0020
E1038
LED CONTROL-LER
E2008
E2036
E2039
E2057
E2056
RECEIVING BUFFER
E2010
SENDING BUFFER
E2028
E0017
SERIAL I/F
E1028
E2007
USB I/F
RECEPTION CONTROL-LER
E2038
RECEIVING BUFFER CONTROLLER
E2040
E0016
PARALLEL I/F
E1030
E2006
1284 I/F
E2001
E2036
CPU I/F
E2002
PLL
E2058
E2059
E1015
E2034
(INTERRUPT)
E2032
(SOFT RESET)
(CLOCK)
E2031
E2033
(PLL CONTROL)
E1014 (CONTROL BUS)
ASIC
E1007
E1001
E1006

PRINTHEAD, PRINTING APPARATUS USING THE SAME, AND PRINTHEAD CONTROL METHOD

FIELD OF THE INVENTION

The present invention relates to a printhead, a printing apparatus using the same, and a printhead control method and, more particularly, to exchange of data between the printhead and the printing apparatus using the same.

Note that the present invention is applicable not only to a general printing apparatus but also to a copying machine, a facsimile apparatus having a communication system, a word processor having a printing unit, and an industrial printing apparatus combined with various processors.

BACKGROUND OF THE INVENTION

An example of information output apparatuses in a word processor, personal computer, facsimile apparatus, and the like is a printer for printing information such as desired characters and images on a sheet-like printing medium such as a paper sheet or film.

As the printing method of the printer, various methods have been known. In recent years, an inkjet method receives a great deal of attention because information can be printed on a printing medium such as a paper sheet in a non-contact manner, and color information can be easily printed, and printing is very quiet. As the inkjet method, a serial printing method of mounting a printhead for discharging ink in accordance with desired printing information, and printing the information while reciprocally scanning the printhead in a direction perpendicular to the feeding direction of a printing medium such as a paper sheet is widely used because of low cost and small size.

Data such as printing information to be input to the printhead is generally input to the printhead in synchronism with an externally applied clock signal.

As disclosed in Japanese Patent Laid-Open No. 10-251479, the printhead incorporates a temperature sensor, an A/D converter for converting an output from the temperature sensor into digital information and outputting the digital information as a pulse signal, and a memory for storing element characteristics based on variations in printing elements during the manufacture process. In reading such information from the printhead, data is output from the printhead in synchronism with an externally supplied clock signal.

To simplify the internal circuit of the printhead, the same clock signal is used to input and read these data, and the same frequency is used to input and data to and from the printhead.

In recent years, as the printing density (number of printing pixels) increases, a higher printing speed is required. To achieve this, the printhead must be constituted by many printing elements (nozzles) at high density, and the frequency of driving each printing element and the printing data transfer speed must be increased.

If the frequency of a clock signal serving as the reference of the printing data transfer speed is increased, the response speed of an analog circuit for processing an output from a sensor arranged in the printhead must be increased in reading data from the printhead.

Especially when an output from the temperature sensor in the printhead is converted into a digital signal by an A/D converter arranged inside the printhead, and transmitted to the printer main body, the response speeds of the A/D converter and output circuit must be increased to output the digital signal in synchronism with a clock signal whose frequency is increased for a high printing speed. As a result, the yield decreases due to a small design margin, and the circuit scale increases.

In addition, a high-frequency clock signal readily generates high-frequency noise inside the printhead or at a wiring portion where the printhead is connected to the printer main body. This noise affects a circuit such as an A/D converter for processing an analog signal, and output data degrades.

SUMMARY OF THE INVENTION

The present invention has been made to overcome the conventional drawbacks, and has as its object to provide a printhead capable of outputting information about the state of the printhead at a proper speed while increasing the printing data input speed, a printing apparatus using the same, and a printhead control method.

To achieve the above object, according to the present invention, a printhead which has a plurality of printing elements and drives each printing element in accordance with input printing data to perform printing comprises a clock signal input terminal for externally receiving a plurality of clock signals having different frequencies, input means for converting the printing data input in synchronism with a clock signal having a first frequency supplied to the clock signal input terminal into data corresponding to the printing elements, and output means for externally outputting information about a state of the printhead in synchronism with a clock signal which is supplied to the clock signal input terminal and has a second frequency lower than the first frequency.

The above object can also be achieved by a printing apparatus according to the present invention which performs printing using this printhead, and comprises clock signal generation means for generating clock signals having the first and second frequencies.

To achieve the above object, according to the present invention, a control method for a printhead which has a plurality of printing elements and drives each printing element in accordance with input printing data to perform printing comprises the input step of converting the printing data input in synchronism with an externally supplied clock signal having a first frequency into data corresponding to the printing elements, the output step of externally outputting information about a state of the printhead in synchronism with an externally supplied clock signal having a second frequency lower than the first frequency, and the control step of controlling operation states in the input and output steps in accordance with a frequency of an externally supplied clock signal.

In the present invention, the printing apparatus main body supplies clock signals having a first frequency and a second frequency lower than the first frequency. Printing data which influences an increase in printing speed is input in synchronism with the first clock signal, and information about the state of the printhead is output in synchronism with the second clock signal.

In reading from a sensor or memory arranged inside the printhead that does not influence the printing speed, a clock having a low frequency is used in consideration of the response speed of a circuit whose speed is difficult to increase, while increasing the printing speed. This suppresses an increase in circuit scale, an increase in the precision of a component used, and an increase in cost. Further, output information about the state of the printhead is prevented from being degraded by high-frequency noise generated by a clock.

Input and output operation states are preferably controlled in response to the frequency of a clock signal supplied to the clock signal input terminal.

Information about the state of the printhead preferably includes the characteristics of the printing element.

Information about the state of the printhead preferably includes an output from a sensor arranged inside the printhead, and the output from the sensor is preferably converted into a digital signal.

In this case, an example of the sensor is a temperature sensor for measuring the temperature of the printhead.

The clock signal supplied to the clock signal input terminal is preferably frequency-divided, and the output means preferably outputs a digital signal converted by A/D conversion means, in synchronism with a signal obtained by frequency-dividing the clock signal having the second frequency.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 9 is a block diagram showing the internal arrangement of an ASIC shown in FIG. 8;

DETAILED DESCRIPTION OF THE PREFERRED EMBODIMENTS

Preferred embodiments of the present invention will now be described in detail in accordance with the accompanying drawings.

In the embodiments to be explained below, a printing apparatus using an inkjet printing system will be described by taking a printer as an example.

In this specification, "print" is not only to form significant information such as characters and graphics but also to form, e.g., images, figures, and patterns on printing media in a broad sense, regardless of whether the information formed is significant or insignificant or whether the information formed is visualized so that a human can visually perceive it, or to process printing media. "Printing media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

Apparatus Main Body

Figure 1:
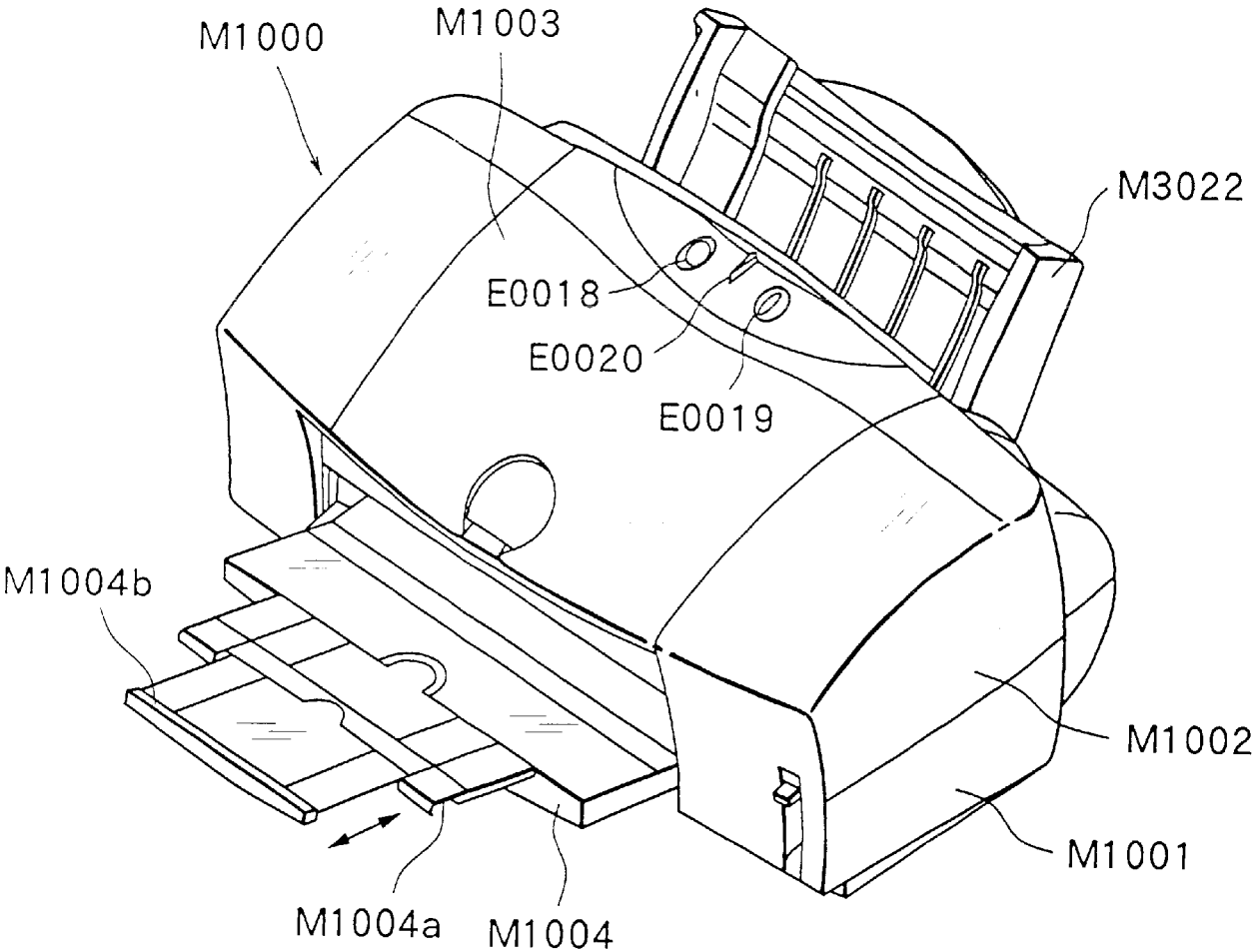
FIG. 1 is a perspective view showing the external appearance of an inkjet printer according to an embodiment of the present invention.
Figure 2:
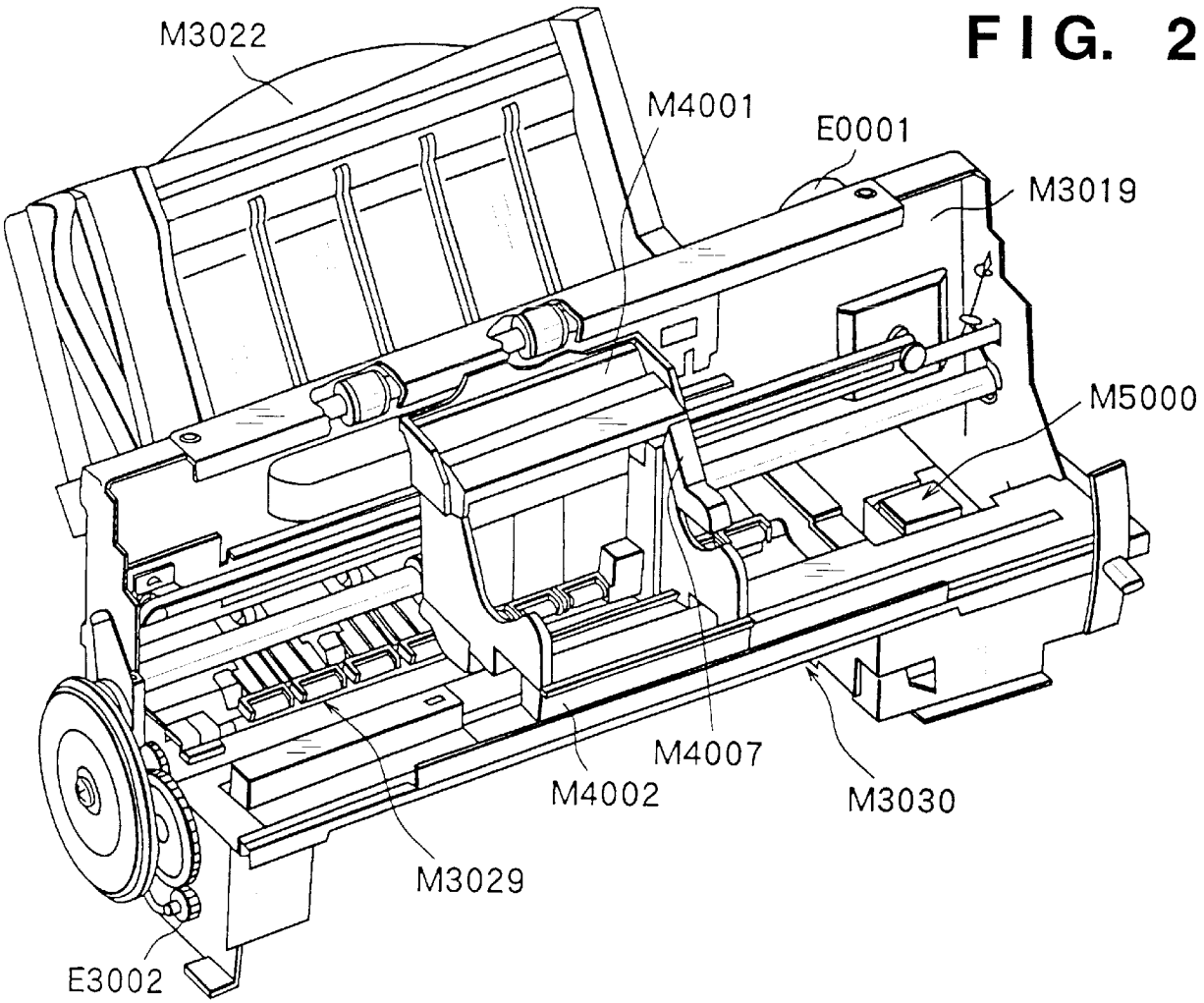
FIG. 2 is a perspective view showing the state in which external parts of the printer shown in FIG. 1 are removed.

FIGS. 1 and 2 show an outline of the arrangement of a printer using an inkjet printing system. Referring to FIG. 1, an apparatus main body M1000 as a shell of the printer according to this embodiment is composed of external members, i.e., a lower case M1001, upper case M1002, access cover M1003, and delivery tray M1004, and a chassis M3019 (FIG. 2) accommodated in these external members.

The chassis M3019 is made of a plurality of plate-like metal members having predetermined stiffness, forms a framework of the printing apparatus, and holds various printing mechanisms to be described later.

The lower case M1001 forms a substantially lower half of the apparatus main body M1000, and the upper case M1002 forms a substantially upper half of the apparatus main body M1000. The combination of these two cases forms a hollow structure having a housing space for housing diverse mechanisms to be described later. Openings are formed in the top surface and the front surface of this hollow structure.

One end portion of the delivery tray M1004 is rotatably held by the lower case M1001. By rotating this delivery tray M1004, the opening formed in the front surface of the lower case M1001 can be opened and closed. When printing is to be executed, therefore, the delivery tray M1004 is rotated forward to open the opening to allow printing sheets to be delivered from this opening, and delivered printing sheets P can be stacked in order. Also, the delivery tray M1004 accommodates two auxiliary trays M1004*a* and M1004*b*. By pulling each tray forward as needed, the sheet support area can be increased and reduced in three steps.

One end portion of the access cover M1003 is rotatably held by the upper case M1002. This allows this access cover M1003 to open and close the opening formed in the top surface of the upper case M1002. By opening this access cover M1003, a printhead cartridge H1000 or an ink tank H1900 housed inside the main body can be replaced. Although not shown, when the access cover M1003 is opened or closed, a projection formed on the rear surface of this access cover M1003 rotates a cover opening/closing lever. A microswitch or the like detects the rotated position of this lever. In this way, the open/closed state of the access cover can be detected.

Figure 7:
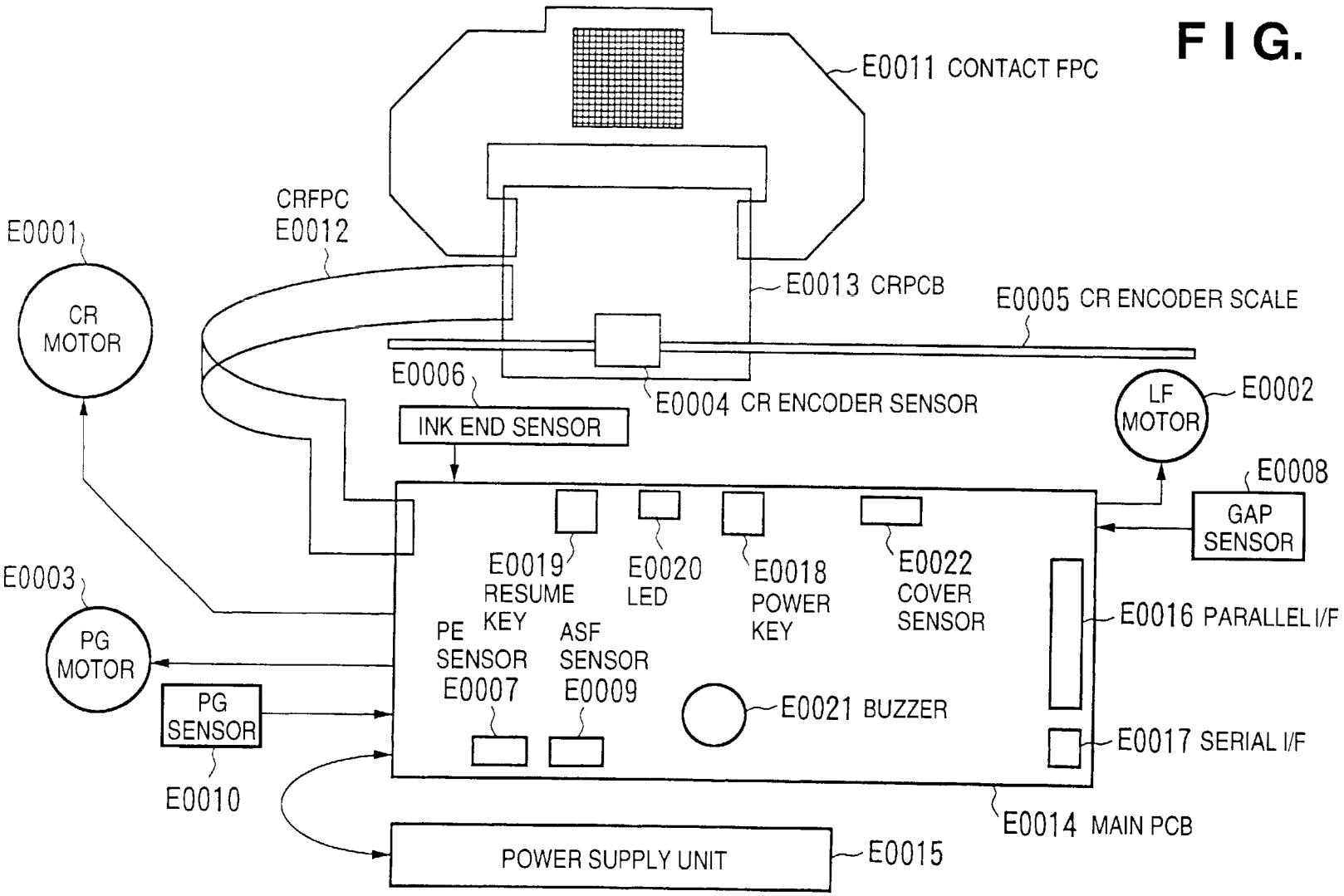
FIG. 7 is a block diagram schematically showing the overall arrangement of an electronic circuit in the embodiment of the present invention.

On the top surface in the rear portion of the upper case M1002, a power key E0018 and a resume key E0019 are arranged to be able to be pressed, and an LED E0020 is also arranged. When the power key E0018 is pressed, the LED E0020 is turned on to inform the operator that printing is possible. This LED E0020 has various display functions, e.g., informs the operator of a trouble of the printer by changing the way the LED E0020 turns on and off, changing the color of light, or sounding a buzzer E0021 (FIG. 7). When the trouble is solved, printing is restarted by pressing the resume key E0019.

Printing Mechanisms

Printing mechanisms of this embodiment housed in and held by the apparatus main body M1000 of the above printer will be described below.

The printing mechanisms according to this embodiment are: an automatic feeder M3022 for automatically feeding the printing sheets P into the apparatus main body; a conveyor unit M3029 for guiding the printing sheets P fed one by one from the automatic feeder to a desired printing position and guiding these recording sheets P from the printing position to a delivery unit M3030; a printing unit for performing desired printing on each printing sheet P conveyed by the conveyor unit M3029; and a recovery unit (M5000) for recovering, e.g., the printing unit.

Printing Unit

The printing unit will be described below.

This printing unit includes a carriage M4001 movably supported by a carriage shaft M4021, and the printhead cartridge H1000 detachably mounted on this carriage M4001.

Printhead Cartridge

First, the printhead cartridge will be described with reference to FIGS. 3 to 5.

Figure 3:
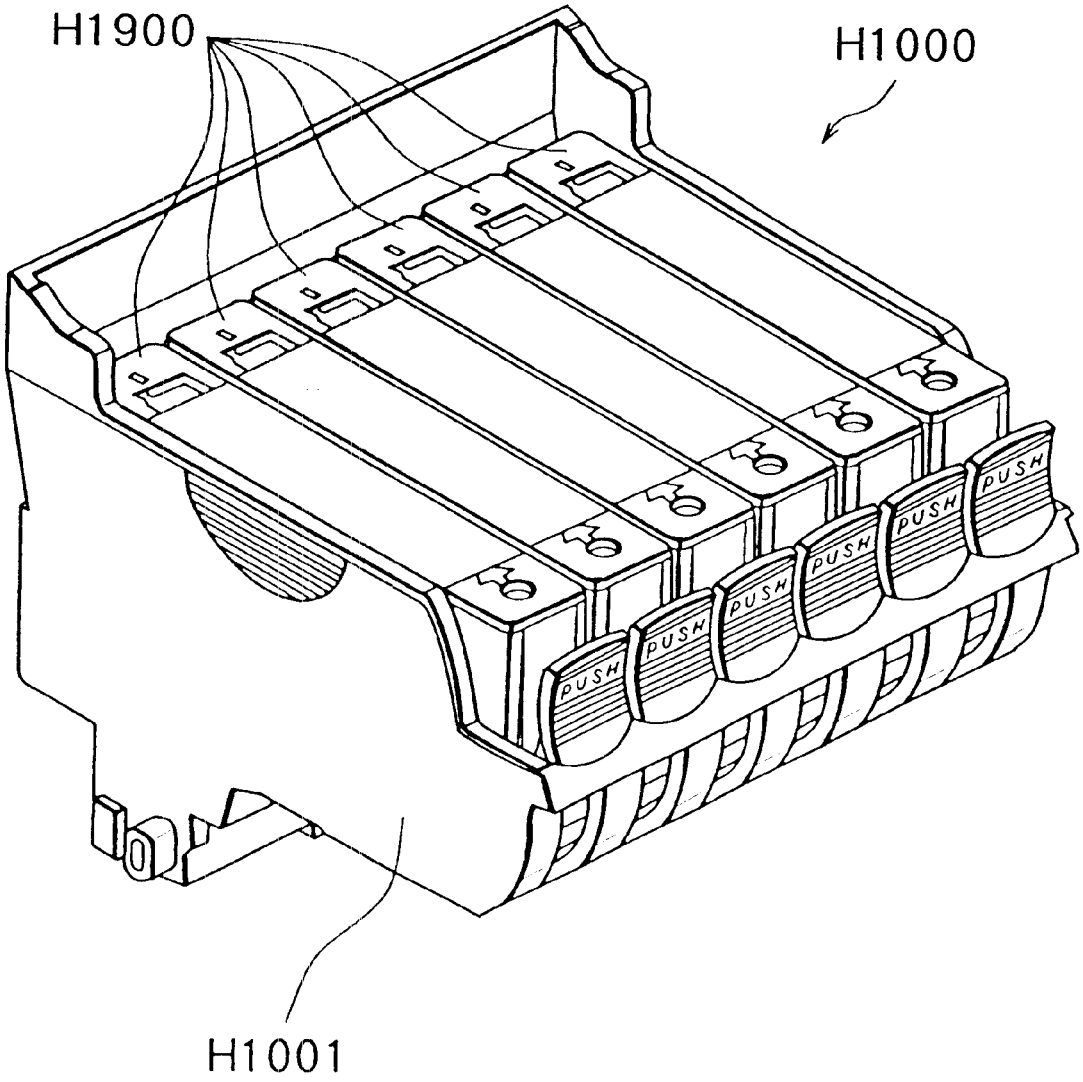
FIG. 3 is a side perspective view showing the state in which a printhead cartridge shown in FIG. 4 is assembled.
Figure 4:
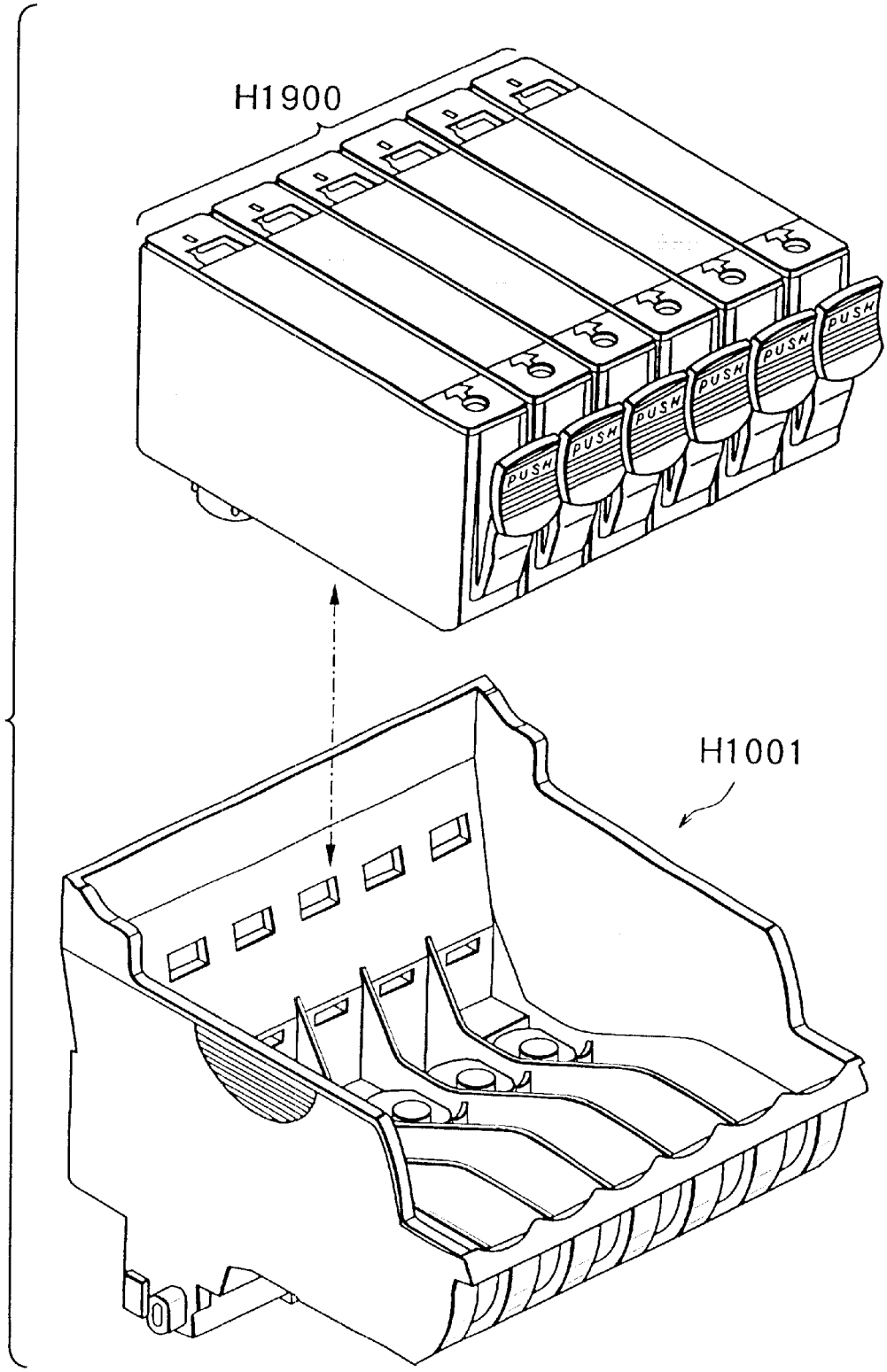
FIG. 4 is an exploded perspective view showing the printhead cartridge used in the embodiment of the present invention.

As shown in FIG. 3, the printhead cartridge H1000 of this embodiment has the ink tank H1900 containing ink and a printhead H1001 for discharging the ink supplied from this ink tank H1900 from nozzles in accordance with printing information. This printhead H1001 is of a so-called cartridge type detachably mounted on the carriage M4001 (to be described later).

To make photographic high-quality color printing feasible, the printhead cartridge H1000 of this embodiment includes independent color ink tanks, e.g., black, light cyan, light magenta, cyan, magenta, and yellow ink tanks. As shown in FIG. 4, these ink tanks can be independently attached to and detached from the printhead H1001.

Figure 5:
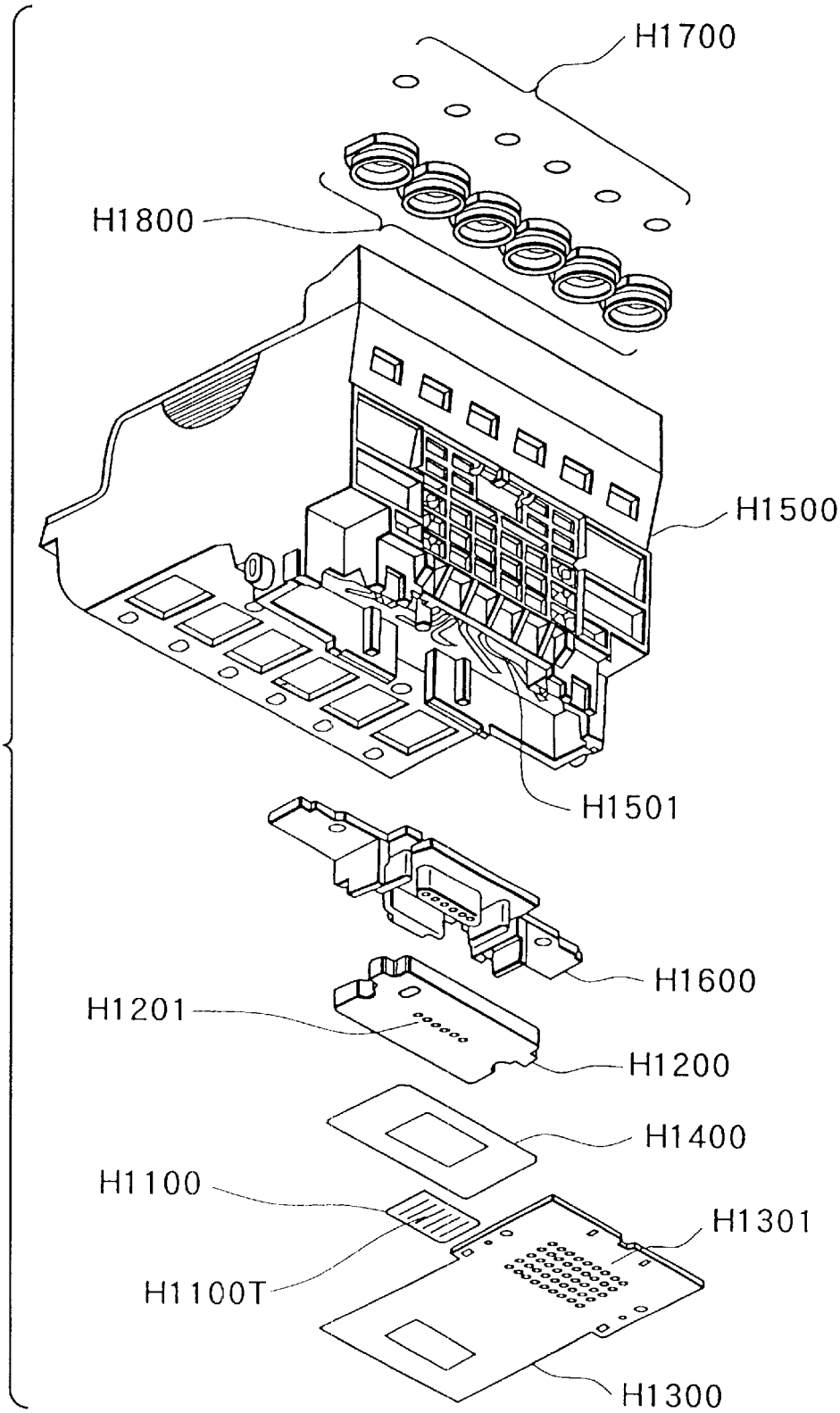
FIG. 5 is an exploded perspective view showing the printhead of FIG. 3 when obliquely viewed from below.

As shown in an exploded perspective view of FIG. 5, the printhead H1001 comprises a printing element board H1100, first plate H1200, electrical printed circuit board H1300, second plate H1400, tank holder H1500, channel forming member H1600, filters H1700, and sealing rubber members H1800.

On the printing element board H1100, a plurality of printing elements for discharging ink and electric lines made of, e.g., Al for supplying electric power to these printing elements are formed on one surface of an Si substrate by film formation technologies. A plurality of ink channels and a plurality of discharge orifices H1100T corresponding to the printing elements are formed by photolithography. Also, ink supply ports for supplying ink to these ink channels are formed in the rear surface. This printing element board H1100 is fixed to the first plate H1200 by adhesion. Ink supply ports H1201 for supplying ink to the printing element board H1100 are formed in this first plate H1200. Furthermore, the second plate H1400 having an opening is fixed to the first plate H1200 by adhesion. This second plate H1400 holds the electric printed circuit board 1300 such that the electric printed circuit board H1300 and the printing element board H1100 are electrically connected.

This electric printed circuit board H1300 applies an electrical signal for discharging ink to the printing element board H1100. The electric printed circuit board H1300 has electric lines corresponding to the printing element board H1100, and external signal input terminals H1301 formed in end portions of these electric lines to receive electrical signals from the main body. The external signal input terminals H1301 are positioned and fixed at the back of the tank holder H1500.

The channel forming member H1600 is ultrasonically welded to the tank holder H1500 for detachably holding the ink tanks H1900, thereby forming ink channels H1501 from the ink tanks H1900 to the first plate H1200. Also, the filters H1700 are formed at those end portions of the ink channels H1501, which engage with the ink tanks H1900, to prevent invasion of dust from the outside. The sealing rubber members H1800 are attached to the portions engaging with the ink tanks H1900 to prevent evaporation of ink from these engaging portions.

Furthermore, the printhead H1001 is constructed by bonding, by an adhesive or the like, a tank holder unit composed of the tank holder H1500, channel forming member H1600, filters H1700, and sealing rubber members H1800 to a printing element unit composed of the printing element board H1100, first plate H1200, electric printed circuit board H1300, and second plate H1400.

Carriage

The carriage M4001 will be described below with reference to FIG. 2.

As shown in FIG. 2, this carriage M4001 includes a carriage cover M4002 and head set lever M4007. The carriage cover M4002 engages with the carriage M4001 and guides the printhead H1001 to the mount position of the carriage M4001. The head set lever M4007 engages with the tank holder H1500 of the printhead H1001 and pushes the printhead H1000 such that the printhead H1000 is set in a predetermined mount position.

That is, the head set lever M4007 is set in the upper portion of the carriage M4001 so as to be pivotal about a head set level shaft. Also, a head set plate (not shown) is set via a spring in a portion which engages with the printhead H1001. By the force of this spring, the printhead H1001 is pushed and mounted on the carriage M4001.

A contact flexible print cable (to be referred to as a contact FPC hereinafter) E0011 is set in another engaging portion of the carriage M4001 with respect to the printhead H1001. Contact portions E0011*a* on this contact FPC E0011 and the contact portions (external signal input terminals) H1301 formed on the printhead H1001 electrically contact each other to exchange various pieces of information for printing or supply electric power to the printhead H1001.

An elastic member (not shown) made of, e.g., rubber is formed between the contact portions E0011*a* of the contact FPC E0011 and the carriage M4001. The elastic force of this elastic member and the biasing force of the head set lever spring make reliable contact between the contact portions E0011*a* and the carriage M4001 possible. Furthermore, the contact FPC E0011 is connected to a carriage printed circuit board E0013 mounted on the back surface of the carriage M4001 (FIG. 7).

Scanner

The printer of this embodiment is also usable as a reading apparatus by replacing the printhead with a scanner.

This scanner moves together with the carriage of the printer and reads an original image supplied instead of a printing medium in a sub-scan direction. Information of one original image is read by alternately performing the read operation and the original feed operation.

Figure 6B:
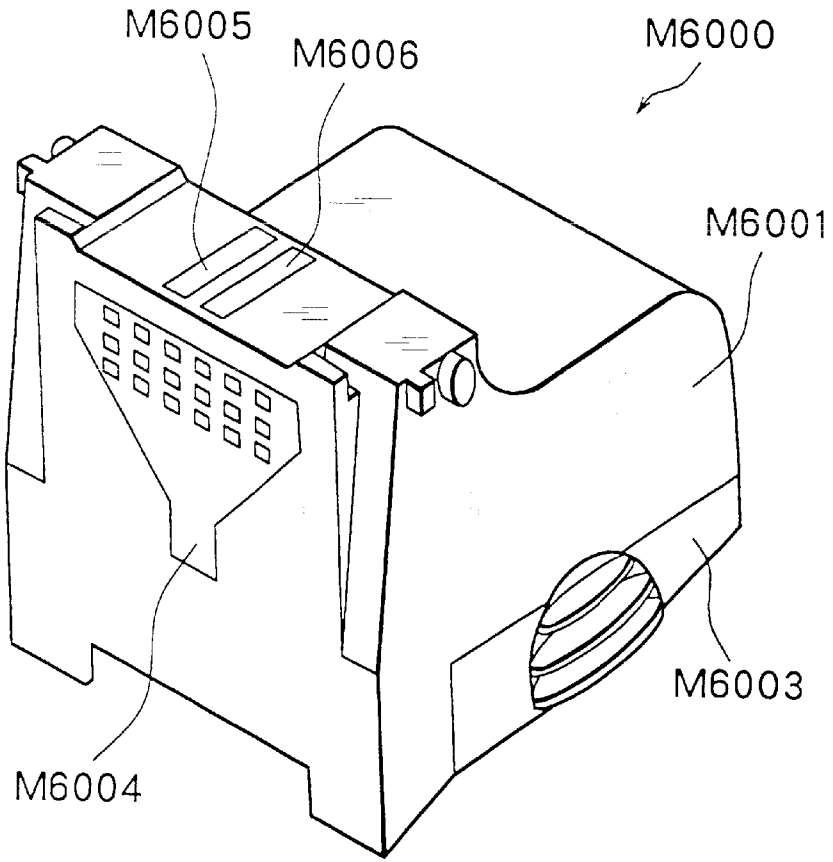
FIGS. 6A and 6B are perspective views showing a scanner cartridge in the embodiment of the present invention.
Figure 6A:
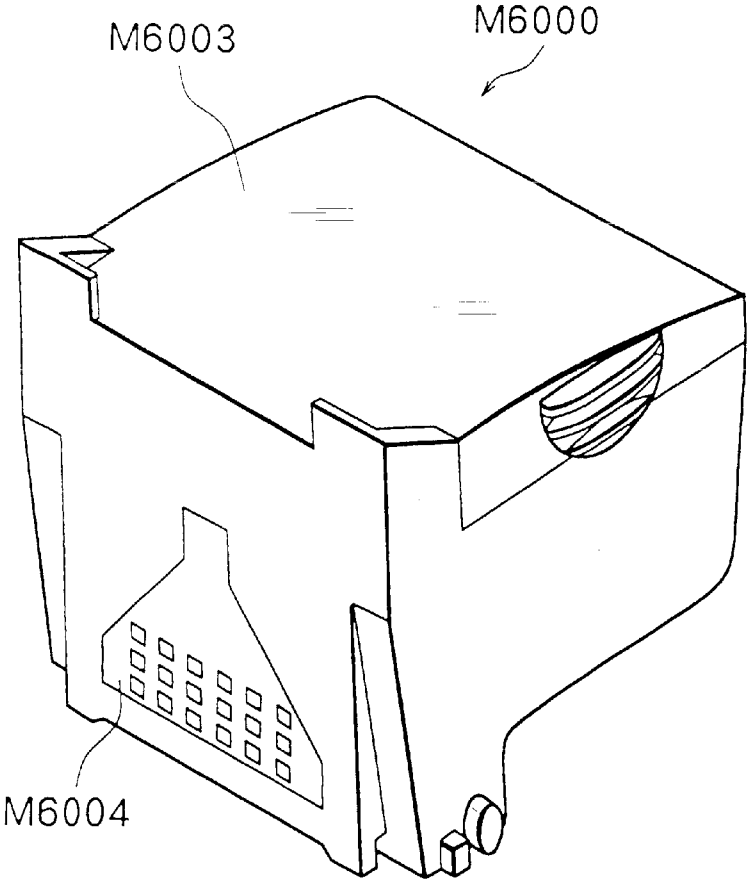

FIGS. 6A and 6B are views showing an outline of the arrangement of this scanner M6000.

As shown in FIGS. 6A and 6B, a scanner holder M6001 has a box-like shape and contains optical systems and processing circuits necessary for reading. A scanner read lens M6006 is placed in a portion which faces the surface of an original when this scanner M6000 is mounted on the carriage M4001. This scanner read lens M6006 reads an original image. A scanner illuminating lens M6005 contains a light source (not shown), and light emitted by this light source irradiates an original.

A scanner cover M6003 fixed to the bottom portion of the scanner holder M6001 so fits as to shield the interior of the scanner holder M6001 from light. Louver-like handles formed on the side surfaces of this scanner cover M6003 facilitate attachment to and detachment from the carriage M4001. The external shape of the scanner holder M6001 is substantially the same as the printhead cartridge H1000. So, the scanner holder M6001 can be attached to and detached from the carriage M4001 by operations similar to the printhead cartridge H1000.

Also, the scanner holder M6001 accommodates a board having the processing circuits described above and a scanner contact PCB M6004 connected to this board and exposed to the outside. When the scanner M6000 is mounted on the carriage M4001, this scanner contact PCB M6004 comes in contact with the contact FPC E0011 of the carriage M4001, thereby electrically connecting the board to the control system of the main body via the carriage M4001.

An electric circuit configuration in this embodiment of the present invention will be described next.

FIG. 7 is a view schematically showing the overall arrangement of an electric circuit in this embodiment.

The electric circuit of this embodiment primarily comprises the carriage printed circuit board (CRPCB) E0013, a main PCB (Printed Circuit Board) E0014, and a power supply unit E0015.

The power supply unit is connected to the main PCB E0014 to supply various levels of driving power.

The carriage printed circuit board E0013 is a printed circuit board unit mounted on the carriage M4001 (FIG. 2) and functions as an interface for exchanging signals with the printhead through the contact FPC E0011. Also, on the basis of a pulse signal output from an encoder sensor E0004 in accordance with the movement of the carriage M4001, the carriage printed circuit board E0013 detects changes in the positional relationship between an encoder scale E0005 and the encoder sensor E0004 and outputs a signal to the main PCB E0014 through a flexible flat cable (CRFFC) E0012.

The main PCB is a printed circuit board unit for controlling driving of individual parts of the inkjet printing apparatus of this embodiment. This main PCB has, on the board, I/O ports for, e.g., a paper end sensor (PE sensor) E0007, an ASF sensor E0009, a cover sensor E0022, a parallel interface (parallel I/F) E0016, a serial interface (serial I/F) E0017, the resume key E0019, the LED E0020, the power key E0018, and the buzzer E0021. The main PCB is also connected to a CR motor E0001, an LF motor E0002, and a PG motor E0003 to control driving of these motors. Additionally, the main PCB has interfaces connecting to an ink end sensor E0006, a GAP sensor E0008, a PG sensor E0010, a CRFFC E0012, and the power supply unit E0015.

Figure 8:
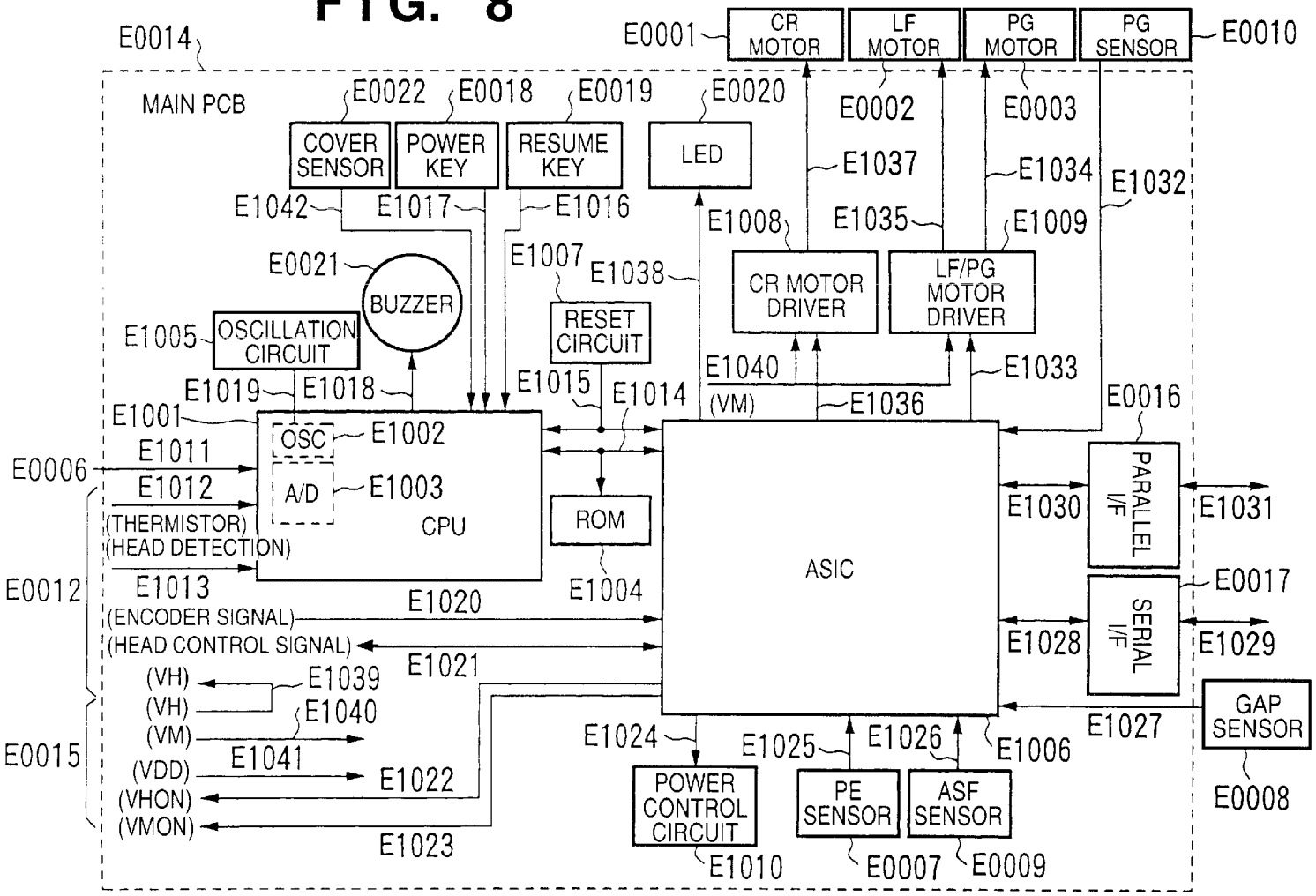
FIG. 8 is a block diagram showing the internal arrangement of a main PCB shown in FIG. 7.

FIG. 8 is a block diagram showing the internal arrangement of the main PCB.

Referring to FIG. 8, a CPU E1001 internally has an oscillator OSC E1002 and is connected to an oscillation circuit E1005 to generate a system clock by an output signal E1019 from the oscillation circuit E1005. Also, the CPU E1001 is connected to a ROM E1004 and an ASIC (Application Specific Integrated Circuit) E1006. In accordance with programs stored in the ROM E1004, the CPU E1001 controls the ASIC and senses the statuses of an input signal E1017 from the power key, an input signal E1016 from the resume key, a cover sensing signal E1042, and a head sensing signal (HSENS) E1013. Additionally, the CPU E1001 drives the buzzer E0021 by a buzzer signal (BUZ) E1018 and senses the statuses of an ink end sensing signal (INKS) E1011 and a thermistor temperature sensing signal (TH) E1012 connected to a built-in A/D converter E1003. Furthermore, the CPU E1001 controls driving of the inkjet printing apparatus by performing various logic operations and condition judgements.

The head sensing signal E1013 is a head mounting sensing signal which the printhead cartridge H1000 inputs via the flexible flat cable E0012, the carriage printed circuit board E0013, and the contact flexible print cable E0011. The ink end sensing signal is an output analog signal from the ink end sensor E0006. The thermistor temperature sensing signal E1012 is an analog signal from a thermistor (not shown) formed on the carriage printed circuit board E0013.

A CR motor driver E1008 is supplied with motor power (VM) E1040 as a driving source. In accordance with a CR motor control signal E1036 from the ASIC E1006, the CR motor driver E1008 generates a CR motor driving signal E1037 to drive the CR motor E0001. An LF/PG motor driver E1009 is also supplied with the motor power E1040 as a driving source. In accordance with a pulse motor control signal (PM control signal) E1033 from the ASIC E1006, the LF/PG motor driver E1009 generates an LF motor driving signal E1035 to drive the LF motor and also generates a PG motor driving signal E1034 to drive the PG motor.

A power control circuit E1010 controls power supply to each sensor having a light-emitting element, in accordance with a power control signal E1024 from the ASIC E1006. The parallel I/F E0016 transmits a parallel I/F signal E1030 from the ASIC E1006 to a parallel I/F cable E1031 connected to the outside, and transmits signals from this parallel I/F cable E1031 to the ASIC E1006. The serial IF E0017 transmits a serial I/F signal E1028 from the ASIC E1006 to a serial I/F cable E1029 connected to the outside, and transmits signals from this cable E1029 to the ASIC E1006.

The power supply unit E0015 supplies head power (VH) E1039, the motor power (VM) E1040, and logic power (VDD) E1041. A head power ON signal (VHON) E1022 and a motor power ON signal (VMOM) E1023 from the ASIC E1006 are input to the power supply unit E0015 to control ON/OFF of the head power E1039 and the motor power E1040, respectively. The logic power (VDD) E1041 supplied from the power supply unit E0015 is subjected to voltage transformation where necessary and supplied to individual units inside and outside the main PCB E0014.

The head power E1039 is smoothed on the main PCB E0014, supplied to the flexible flat cable E0011, and used to drive the printhead cartridge H1000.

A reset circuit E1007 detects a decrease in the logic power-supply voltage E1040 and supplies a reset signal (RESET) E1015 to the CPU E1001 and the ASIC E1006 to initialize them.

This ASIC E1006 is a one-chip semiconductor integrated circuit which is controlled by the CPU E1001 via a control bus E1014, outputs the CR motor control signal E1036, the PM control signal E1033, the power control signal E1024, the head power ON signal E1022, and the motor power ON signal E1023, and exchanges signals with the parallel I/F E10016 and the serial I/F E0017. Also, the ASIC E1006 senses the statuses of a PE sensing signal (PES) E1025 from the PE sensor E0007, an ASF sensing signal (ASFS) E1026 from the ASF sensor E0009, a GAP sensing signal (GAPS) E1027 from the GAP sensor E0008, and a PG sensing signal (PGS) E1032 from the PG sensor E0010, and transmits data indicating the statuses to the CPU E1001 through the control bus E1014. On the basis of the input data, the CPU E1001 controls driving of the LED driving signal E1038 to turn on and off the LED E0020.

Furthermore, the ASIC E1006 senses the status of an encoder signal (ENS) E1020 to generate a timing signal and interfaces with the printhead cartridge H1000 by a head control signal E1021, thereby controlling a printing operation. The encoder signal (ENC) E1020 is an output signal from the CR encoder sensor E0004, that is input through the flexible flat cable E0012. The head control signal E1021 is supplied to the printhead cartridge E1000 through the flexible flat cable E0012, the carriage printed circuit board E0013, and the contact FPC E0011.

FIG. 9 is a block diagram showing the internal arrangement of the ASIC E1006.

Referring to FIG. 9, only flows of data, such as printing data and motor control data, pertaining to control of the head and each mechanical part, are shown in connections between individual blocks. Control signals and clocks concerning read and write of a built-in register in each block and control signals related to DMA control are omitted to avoid the complexity of description in the drawing.

As shown in FIG. 9, a PLL E2002 generates a clock (not shown) to be supplied to the most part of the ASIC E1006, in accordance with a clock signal (CLK) E2031 and PLL control signal (PLLON) E2033 output from the CPU E1001.

A CPU interface (CPU I/F) E2001 controls read and write to a register in each block (to be described below), supplies clocks to some blocks, and accepts an interrupt signal (none of these functions is shown), in accordance with the reset signal E1015, a soft reset signal (PDWN) E2032 and the clock signal (CLK) E2031 output from the CPU E1001, and a control signal from the control bus E1014. This CPU I/F E2001 outputs an interrupt signal (INT) E2034 to the CPU E1001 to inform the CPU E1001 of generating an interrupt in the ASIC E1006.

A DRAM E2005 has areas such as a receiving buffer E2010, work buffer E2011, print buffer E2014, and expanding data buffer E2016, as printing data buffers, and also has a motor control buffer E2023 for motor control. In addition to these printing data buffers, the DRAM E2005 has areas such as a scanner loading buffer E2024, scanner data buffer E2026, and sending buffer E2028, as buffers for use in a scanner operation mode.

This DRAM E2005 is also used as a work area necessary for the operation of the CPU E1001. That is, a DRAM controller E2004 switches between access from the CPU E1001 to the DRAM E2005 using the control bus and access from a DMA controller E2003 (to be described below) to the DRAM E2005, thereby performing read and write to the DRAM E2005.

The DMA controller E2003 accepts a request (not shown) from each block and outputs, to the RAM controller, an address signal and a control signal (neither is shown), or write data (E2038, E2041, E2044, E2053, E2055, or E2057) when a write operation is to be performed, thereby performing DRAM access. When a read operation is to be performed, the DMA controller E2003 transfers readout data (E2040, E2043, E2045, E2051, E2054, E2056, E2058, or E2059) from the DRAM controller E2004 to the block which has requested.

A 1284 I/F E2006 interfaces by two-way communication with an external host apparatus (not shown) through the parallel I/F E0016 under the control of the CPU E1001 via the CPU I/F E2001. Also, when printing is to be performed, the 1284 I/F E2006 transfers received data (PIF received data E2036) from the parallel I/F E0016 to a reception controller E2008 by DMA processing. When scanner read is to be performed, the 1284 I/F E2006 transmits data (1284 transmission data (RDPIF) E2059) stored in the sending buffer E2028 in the DRAM E2005 to the parallel I/F by DMA processing.

A USB I/F E2007 interfaces by two-way communication with an external host apparatus (not shown) through the serial I/F E0017 under the control of the CPU E1001 via the CPU I/F E2001. Also, when printing is to be performed, the USB I/F E2007 transfers received data (USB received data E2037) from the serial I/F E0017 to the reception controller E2008 by DMA processing. When scanner read is to be performed, the USB I/F E2007 transmits data (USB transmission data (RDPIF) E2058) stored in the sending buffer E2028 in the DRAM E2005 to the serial I/F by DMA processing. The reception controller E2008 writes received data (WDIF) E2038) from a selected one of the 1284 I/F E2006 and the USB I/F E2007 into a receiving buffer write address managed by a receiving buffer controller E2039.

A compression-expansion DMA E2009 reads out, under the control of the CPU E1001 via the CPU I/F E2001, received data (raster data) stored on the receiving buffer E2010 from a receiving buffer read address managed by the receiving buffer controller E2039, compresses or expands readout data (RDWK) E2040 in accordance with a designated mode, and writes the data as a printing code string (WDWK) E2041 in the work buffer area.

A printing buffer transfer DMA E2013 reads out, under the control of the CPU E1001 via the CPU I/F E2001, printing codes (RDWP) E2043 on the work buffer E2011, rearranges each printing code into an address on the print buffer E2014, which is suitable for the order of data transfer to the printhead cartridge H1000, and transfers the code (WDWP E2044). A work clear DMA E2012 repeatedly transfers and writes, under the control of the CPU E1001 via the CPU I/F E2001, designated work file data (WDWF) E2042 in a region on the work buffer to which the data is completely transferred by the printing buffer transfer DMA E2015.

A printing data expanding DMA E2015 reads out, under the control of the CPU E1001 via the CPU I/F E2001, the printing codes rearranged and written on the print buffer and expanding data written on the expanding data buffer E2016, by using a data expansion timing signal E2050 from a head controller E2018 as a trigger, thereby generating expanded printing data (WDHDG) E2045, and writes the generated data as column buffer write data (WDHDG) E2047 in a column buffer E2017. This column buffer E2017 is an SRAM for temporarily storing data (expanded printing data) to be transferred to the printhead cartridge H1000. The column buffer E2017 is shared and managed by the printing data expanding DMA and the head controller in accordance with a handshake signal (not shown) of these two blocks.

Under the control of the CPU E1001 via the CPU I/F E2001, this head controller E2018 interfaces with the printhead cartridge H1000 or the scanner via a head control signal. In addition, on the basis of a head driving timing signal E2049 from an encoder signal processor E2019, the head controller E2018 outputs a data expansion timing signal E2050 to the printing data expanding DMA.

When printing is to be performed, the head controller E2018 reads out expanded printing data (RDHD) E2048 from the column buffer in accordance with the head driving timing signal E2049. The head controller E2018 outputs the readout data to the printhead cartridge H1000 via the head control signal E1021.

In a scanner read mode, the head controller E2018 transfers loaded data (WDHD) E2053 input via the head control signal E1021 to the scanner loading buffer E2024 on the DRAM E2005 by DMA transfer. A scanner data processing DMA E2025 reads out, under the control of the CPU E1001 via the CPU I/F E2001, loading buffer readout data (RDAV) E2054 stored in the scanner loading buffer E2024 into a scanner data buffer E2026 on the DRAM E2005 and writes processed data (WDAV) E2055, subjected to processing such as averaging, into the scanner data buffer E2016 on the DRAM E2005.

A scanner data compressing DMA E2027 reads out processed data (RDYC) E2056 on the scanner data buffer E2026, compresses the data, and writes compressed data (WDYC) E2057 in the sending buffer E2028, under the control of the CPU E1001 via the CPU I/F E2001.

The encoder signal processor E2019 receives an encoder signal (ENC) and outputs the head driving timing signal E2049 in accordance with a mode determined by the control of the CPU E1001. In addition, the encoder signal processor E2019 stores information concerning the position or speed of the carriage M4001, obtained from the encoder signal E1020, into a register and provides the information to the CPU E1001. On the basis of this information, the CPU E1001 determines various parameters for controlling the CR motor E0001. A CR motor controller E2020 outputs a CR motor control signal E1036 under the control of the CPU E1001 via the CPU I/F E2001.

A sensor signal processor E2022 receives output sensing signals from, e.g., the PG sensor E0010, the PE sensor E0007, the ASF sensor E0009, and the GAP sensor E0008, and transmits these pieces of sensor information to the CPU E1001 in accordance with a mode determined by the control of the CPU E1001. The sensor signal processor E2022 also outputs a sensor signal E2052 to an LF/PG motor control DMA E2021.

Under the control of the CPU E1001 via the CPU I/F E2001, this LF/PG motor control DMA E2021 reads out a pulse motor driving table (RDPM) E2051 from a motor control buffer E2023 on the DRAM E2005 and outputs a pulse motor control signal E. In addition, the LF/PG motor control DMA E2021 outputs a pulse motor control signal E1033 by using the abovementioned sensor signal as a trigger of the control.

An LED controller E2030 outputs an LED driving signal E1038 under the control of the CPU E1001 via the CPU I/F E2001. A port controller E2029 outputs the head power ON signal E1022, the motor power ON signal E1023, and the power control signal E1024 under the control of the CPU E1001 via the CPU I/F E2001.

Figure 10:
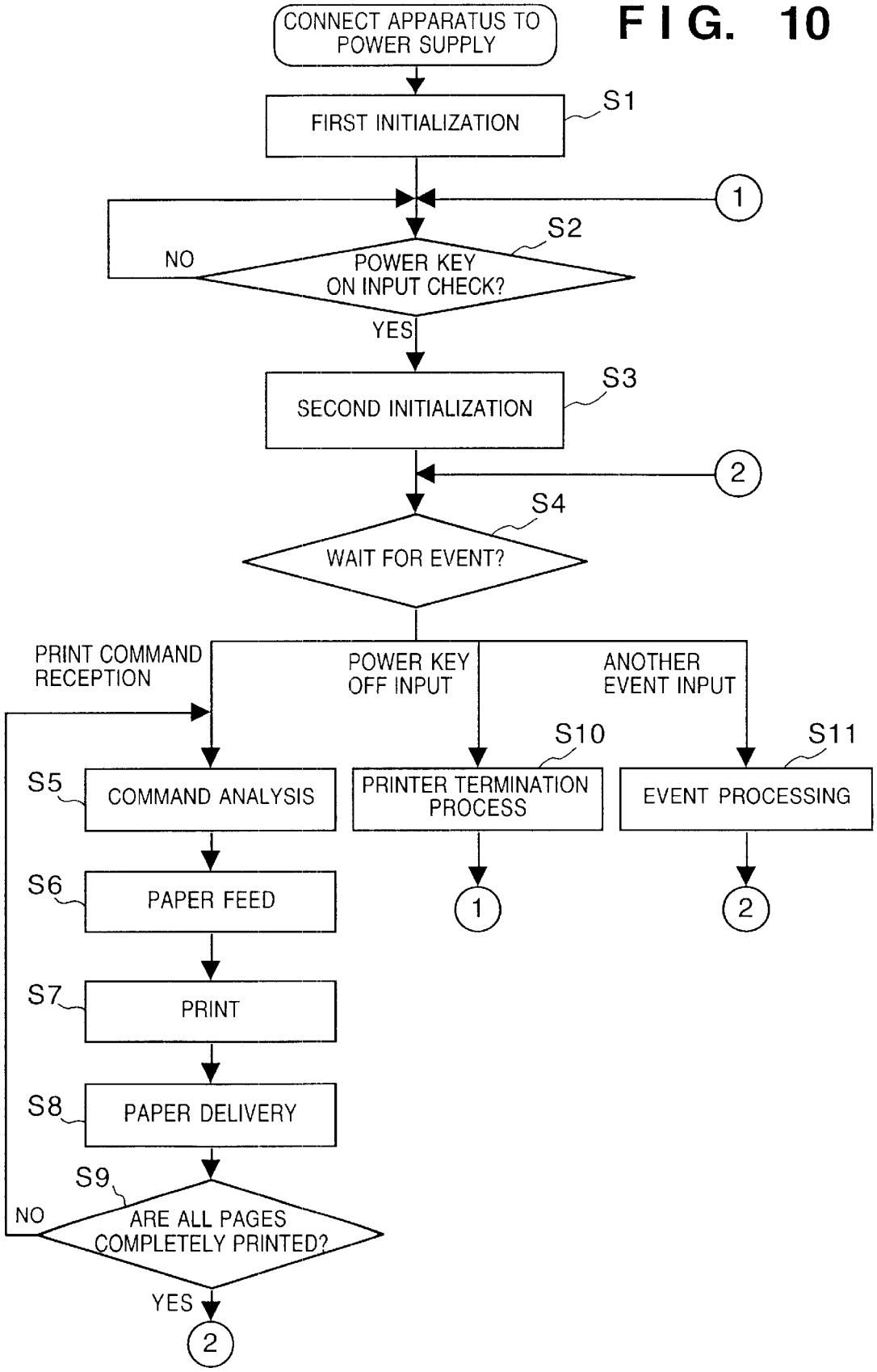
FIG. 10 is a flow chart showing the operation of the embodiment of the present invention.

The operation of the inkjet printing apparatus of this embodiment of the present invention constructed as above will be described below with reference to a flow chart in FIG. 10.

When this apparatus is connected to the AC power supply, in step S1 first initialization is performed for the apparatus. In this initialization, the electric circuit system including, e.g., the ROM and RAM of this apparatus is checked, thereby checking whether the apparatus can normally operate electrically.

In step S2, whether the power key E0018 on the upper case M1002 of the apparatus main body M1000 is pressed is checked. If the power key E0018 is pressed, the flow advances to step S3 to perform second initialization.

In this second initialization, the various driving mechanisms and the head system of this apparatus are checked. That is, whether the apparatus is normally operable is checked in initializing the various motors and loading head information.

In step S4, an event is waited for. That is, a command event from the external I/F, a panel key event by a user operation, or an internal control event with respect to this apparatus is monitored. If any of these events occurs, processing corresponding to the event is executed.

For example, if a printing command event is received from the external I/F in step S4, the flow advances to step S5. If a power key event by a user operation occurs in step S4, the flow advances to step S10. If another event occurs in step S4, the flow advances to step S11.

In step S5, the printing command from the external I/F is analyzed to determine the designated paper type, sheet size, printing quality, and paper feed method. Data indicating these determination results is stored in the RAM E2005 of the apparatus, and the flow advances to step S6.

In step S6, paper feed is started by the paper feed method designated in step S5. When the sheet is fed to a printing start position, the flow advances to step S7.

In step S7, printing is performed. In this printing, printing data supplied from the external I/F is once stored in the printing buffer. Subsequently, the CR motor E0001 is driven to start moving the carriage M4001 in the scanning direction, and the printing data stored in the print buffer E2014 is supplied to the printhead cartridge H1000 to print one line. When the printing data of one line is completely printed, the LF motor E0002 is driven to rotate an LF roller M3001 to feed the sheet in the sub-scan direction. After that, the above operation is repeatedly executed. When printing of the printing data of one page supplied from the external I/F is completed, the flow advances to step S8.

In step S8, the LF motor E0002 is driven to drive a sheet delivery roller M2003. Sheet feed is repeated until it is determined that the sheet is completely delivered from this apparatus. When this operation is completed, the sheet is completely delivered onto the sheet delivery tray M1004*a*.

In step S9, whether printing of all pages to be printed is completed is checked. If pages to be printed remain, the flow returns to step S5 to repeat the operation in steps S5 to S9 described above. When printing of all pages to be printed is completed, the printing operation is completed. After that, the flow returns to step S4 to wait for the next event.

In step S10, a printer termination process is performed to stop the operation of this apparatus. That is, to shut off the power supply to the various motors and the head, the operation transits to a state in which the power supply can be shut off. After that, the power supply is shut off, and the flow returns to step S4 to wait for the next event.

In step S11, event processing other than the above is performed. For example, processing corresponding to any of the diverse panel keys of this apparatus, a recovery command from the external I/F, or an internally occurring recovery event is performed. After the processing, the flow advances to step S4 to wait for the next event.

First Embodiment

Control for data input/output to/from a printhead H1001 in the above-described printer will be described.

Figure 11:
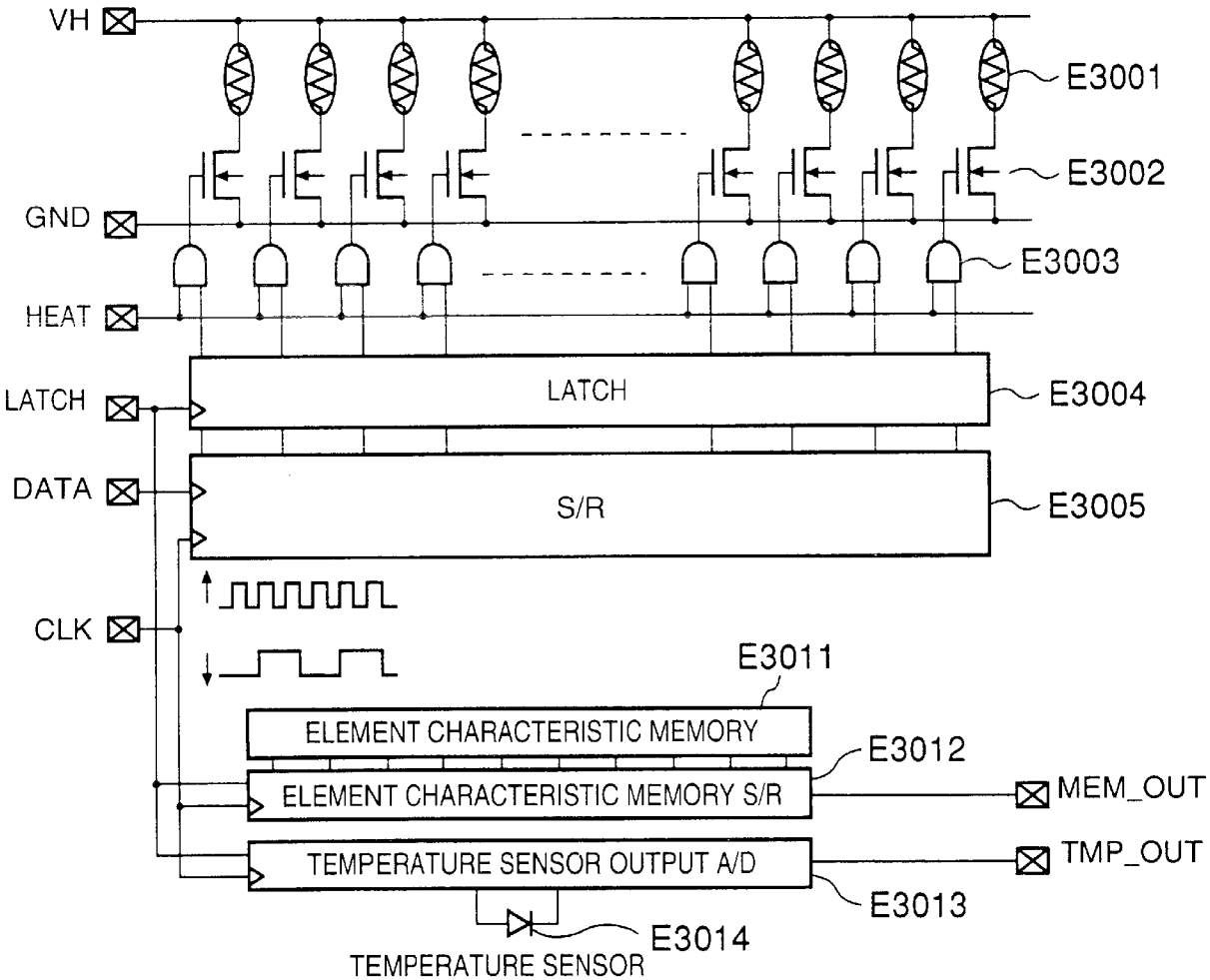
FIG. 11 is a block diagram showing the circuit arrangement of a printing element board in the first embodiment.
Figure 12:
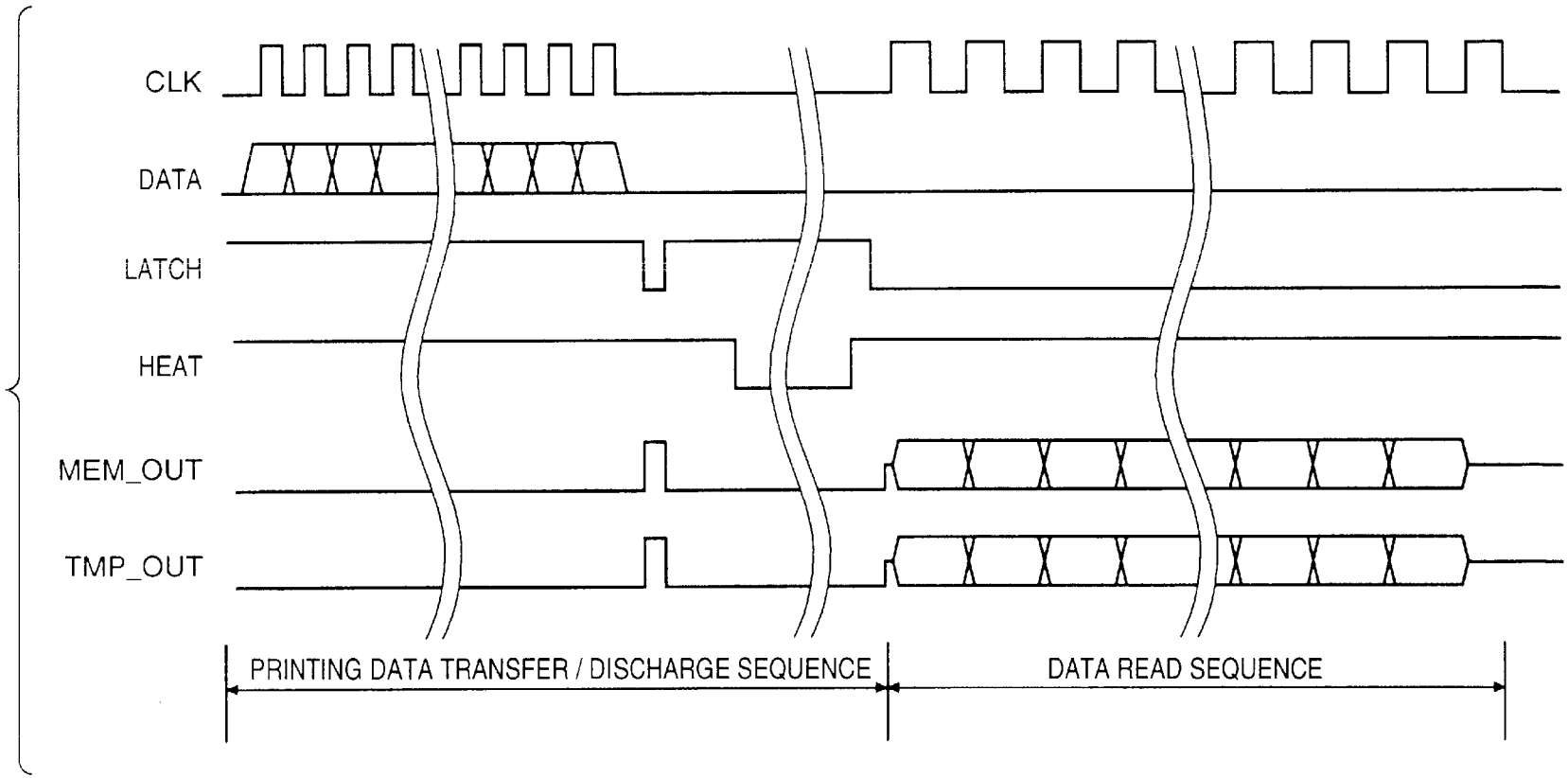
FIG. 12 is a timing chart showing the states of signals in the circuit of FIG. 11.

FIG. 11 is a block diagram showing the circuit of a printing element board H1100 of the printhead H1001 in the first embodiment. FIG. 12 is a timing chart showing the states of signals in the respective units in this block diagram. Note that only a part concerning the printhead is illustrated, and the circuit of a head controller E2018 of the printer main body is not illustrated.

On the printing element board H1100, heaters E3001, driving transistors E3002, and AND gates E3003 are formed in correspondence with respective printing elements. One terminal of each AND gate E3003 is connected to a shift register (S/R) E3005 via a latch (Latch) E3004.

To optimize ink discharge driving control, the printing element board H1100 of the first embodiment comprises, for each printing element, an element characteristic memory E3011 for storing characteristics such as the resistance value of the heater E3001 and the ON resistance of the transistor E3002, an element characteristic memory shift register (S/R) E3012 for serially outputting an output from the element characteristic memory E3011, a temperature sensor E3014 using a diode for sensing the temperature of the printing element board H1100, and a temperature sensor output A/D converter E3013 for converting an output from the temperature sensor E3014 into digital data and serially outputting the digital data.

As signal input terminals, the printing element board H1100 has a heater power supply (VH) terminal, ground (GND) terminal, heat signal (Heat) input terminal, latch signal (Latch) input terminal, data (DATA) input terminal, and clock signal (CLK) input terminal. As signal output terminals, the printing element board H1100 has a memory output (MEM_OUT) terminal and temperature sensor output (TMP_OUT) terminal.

In FIG. 11, printing data DATA is input as serial data from the data input terminal in synchronism with a clock signal CLK supplied from the clock terminal. The input printing data is input to the data transfer shift register (S/R) E3005, and sequentially transferred bit by bit in synchronism with the clock signal CLK. After the printing data is transferred to the respective bits of the shift register, a latch signal Latch is supplied to the latch signal input terminal to temporarily latch the printing data by the latch E3004. Then, the input serial printing data is converted into parallel data.

Then, a heat signal Heat is input from the heat signal input terminal. The AND gate E3003 ANDs the heat signal and the printing data latched by the latch E3004. A transistor E3002 connected to an AND gate whose AND becomes true is driven to flow a current through a corresponding heater E3001.

If a heat pulse for generating thermal energy necessary to bubble and discharge ink is applied, ink is discharged from a nozzle corresponding to the energized heater.

To increase the printing speed, a sequence from data input to discharge must be completed within a short time. Further, the number of ink discharge nozzles, i.e., the number of heaters E3001 must be increased, and the number of bits of the latch E3004 and shift register E3005 must be increased.

For this purpose, a high-frequency clock signal is supplied from the printer main body to the clock input terminal CLK in transmitting printing data.

In transmitting, from the printing element board H1100 to the printer main body, information stored in the element characteristic memory E3011 or an output from the temperature sensor output A/D converter E3013, data is output in synchronism with a clock signal supplied from the printer main body to the printhead.

In the first embodiment, the frequency of the clock signal CLK supplied from the printer main body to the printhead is changed between transfer of printing data and data read from the printhead. The frequency of a clock signal in data read is set lower than that of a clock signal in transfer of printing data.

An operation of switching the frequency of the clock signal CLK will be explained with reference to the timing chart of FIG. 12.

In a printing data transfer/discharge sequence of discharging ink from each nozzle after printing data is transferred from the printer main body to the printhead, a high-frequency clock signal CLK is supplied from the printer main body, and data DATA transmitted in synchronism with the clock signal is transferred to the printing data shift register (S/R) E3005, as described above. After the data is transferred to the shift register E3005, an active low latch signal Latch temporarily changes to "Low", and then the data of the shift register is latched by the latch E3004.

In the arrangement shown in FIG. 11, the clock signal CLK supplied from the clock signal input terminal is supplied not only to the latch E3004 but also to the element characteristic memory shift register E3012 and temperature sensor output A/D converter E3013.

In the first embodiment, the latch signal Latch serves as an output control signal for the element characteristic memory shift register E3012 and temperature sensor output A/D converter E3013. When the latch signal Latch is "High", data of the element characteristic memory shift register E3012 is held, and is not output from the memory output MEM_OUT and temperature sensor output TMP_OUT. When the latch signal Latch is "Low", data is received by the element characteristic memory shift register E3012, and outputs from the memory output MEM_OUT and temperature sensor output TMP_OUT are enabled.

This arrangement prevents any malfunction even if the printer main body supplies clock signals having different frequencies.

In a data read sequence of reading information stored in the element characteristic memory E3011 or temperature information which is sensed by the temperature sensor E3014 and converted into digital data by the temperature sensor output A/D converter E3013, a clock signal CLK having a frequency lower than that of the printing data transfer/discharge sequence is supplied after the latch signal Latch changes to "Low", the element characteristic memory shift register E3012 and temperature sensor output A/D converter E3013 output a memory output signal MEM_OUT and temperature sensor output signal TMP_OUT, respectively.

As described above, according to the first embodiment, data can be output in synchronism with a clock frequency much higher than the response speed of the serial data generation circuit for the temperature or rank information. While the yield is kept high, data can be accurately read. The circuit for outputting information from the printhead need not be increased in speed, so the circuit scale or chip size need not be increased.

Decreasing the clock frequency in data read can reduce the influence of high-frequency noise on the analog signal processing system such as the temperature sensor and A/D converter.

Second Embodiment

The second embodiment of the present invention will be described. The arrangement of the second embodiment is an improvement of the first embodiment. In the following description, the same reference numerals as in the first embodiment denote the same parts or signals, and a description thereof will be omitted.

Figure 13:
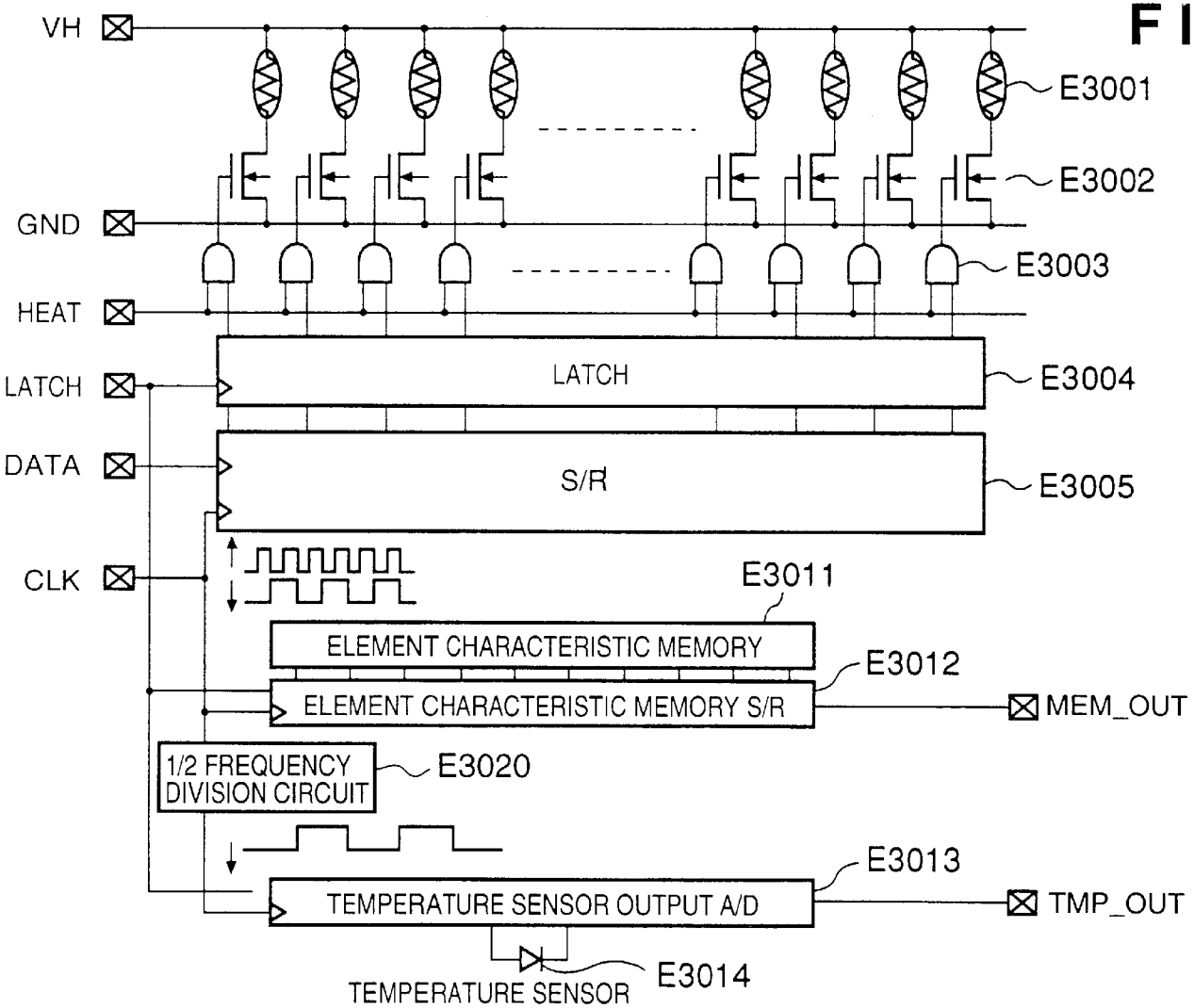
FIG. 13 is a block diagram showing the circuit arrangement of a printing element board in the second embodiment.
Figure 14:
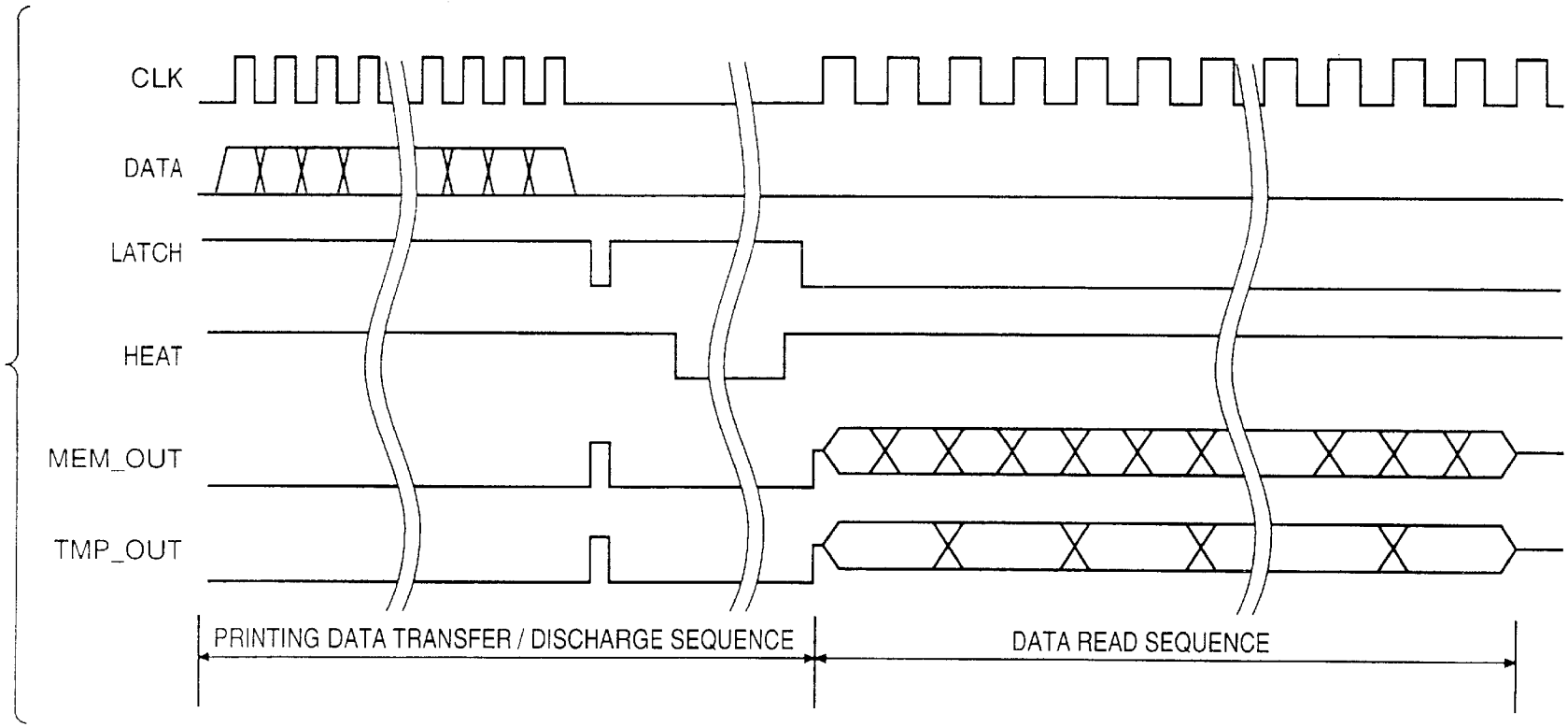
FIG. 14 is a timing chart showing the states of signals in the circuit of FIG. 13.

FIG. 13 is a block diagram showing the circuit arrangement of an element board H1100 of a printhead in the second embodiment. FIG. 14 is a timing chart showing the states of signals in the block diagram of FIG. 13.

On the printing element board H1100, heaters E3001, driving transistors E3002, and AND gates E3003 are formed in correspondence with respective printing elements. One terminal of each AND gate E3003 is connected to a shift register (S/R) E3005 via a latch (Latch) E3004.

To optimize ink discharge driving control, the printing element board H1100 of the second embodiment comprises an element characteristic memory E3011, element characteristic memory shift register (S/R) E3012, temperature sensor E3014, and temperature sensor output A/D converter E3013.

As signal input terminals, the printing element board H1100 has a heater power supply (VH) terminal, ground (GND) terminal, heat signal (Heat) input terminal, latch signal (Latch) input terminal, data (DATA) input terminal, and clock signal (CLK) input terminal. As signal output terminals, the printing element board H1100 has a memory output (MEM_OUT) terminal and temperature sensor output (TMP_OUT) terminal.

As the characteristic arrangement of the second embodiment, a frequency division circuit E3020 is interposed between the clock signal (CLK) input terminal and the temperature sensor output A/D converter E3013. This frequency division circuit E3020 outputs a temperature sensor output (TMP_OUT) output from the temperature sensor output A/D converter E3013, in synchronism with a clock frequency-divided by the frequency division circuit E3020.

Similar to the first embodiment, in reading information stored in the element characteristic memory E3011, a memory output (MEM_OUT) is output in synchronism with a clock signal which is supplied from the printer main body to the clock signal (CLK) input terminal and has a frequency lower than that of a clock signal supplied in transfer of printing data.

An operation in the data read sequence will be explained with reference to the timing chart of FIG. 14. Since the printing data transfer/discharge sequence is the same as in the first embodiment, only the data read sequence will be described.

In the data read sequence, a clock signal CLK having a frequency lower than in the printing data transfer/discharge sequence is supplied. After the latch signal Latch changes to "Low", the element characteristic memory shift register E3012 and temperature sensor output A/D converter E3013 output a memory output signal MEM_OUT and temperature sensor output signal TMP_OUT, respectively.

Read of data stored in the element characteristic memory E3011 uses a clock signal supplied to the clock signal input terminal, similar to the first embodiment. The temperature sensor output A/D converter E3013 receives a clock signal having a much lower frequency that is prepared by frequency-dividing that clock signal by the frequency division circuit E3020. The temperature sensor output A/D converter E3013 outputs a temperature sensor output TMP_OUT in synchronism with the frequency-divided clock signal.

In the second embodiment, a clock signal supplied to the clock signal input terminal is frequency-divided to ½, and a clock signal having a frequency ½ the supplied clock frequency is supplied to the temperature sensor output A/D converter E3013.

According to the second embodiment, for example, when the number of bits of information stored in the element characteristic memory E3011 is larger than the number of bits of data which is output from the temperature sensor and converted into digital data by the A/D converter, and these data are to be simultaneously output, the read speed from the element characteristic memory storing a large information amount is set high, and the read speed for an output from the temperature sensor is set low, in order to simultaneously complete read of the two pieces of information. As a result, the two read times can be made also equal.

The response speed of a circuit such as an A/D converter for processing an analog signal can be adapted to a clock frequency defined by the frequency division circuit. Hence, a large design margin can be ensured for a memory information output whose response speed can be easily increased, and an output from the temperature sensor output circuit whose response speed is difficult to increase.

In the second embodiment, the frequency of a clock signal which defines the output speed of the temperature sensor is obtained by frequency-dividing a supplied clock signal to ½. This is merely an example, and the clock frequency can be divided to a fraction of an arbitrary positive integer such as ⅓ or ¼.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, those practiced by use of the basic principle disclosed in, for example, U.S. Pat. Nos. 4,723,129 and 4,740,796 are preferable. The above system is applicable to either one of so-called on-demand type and continuous type systems. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printing head, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printing head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printing head having a length corresponding to the width of a maximum printing medium which can be printed by the printer, either the arrangement which satisfies the full-line length by combining a plurality of printing heads as disclosed in the above specification or the arrangement as a single printing head obtained by forming printing heads integrally can be used.

In addition, not only an exchangeable chip type printing head, as described in the above embodiment, which can be electrically connected to the apparatus main unit and can receive an ink from the apparatus main unit upon being mounted on the apparatus main unit but also a cartridge type printing head in which an ink tank is integrally arranged on the printing head itself can be applicable to the present invention.

It is preferable to add recovery means for the printing head, preliminary auxiliary means, and the like provided as an arrangement of the printer of the present invention since the printing operation can be further stabilized. Examples of such means include, for the printing head, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printing head or by combining a plurality of printing heads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention.

In the present invention, the above-mentioned film b oiling system is most effective for the above-mentioned inks.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program. In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes Furthermore, besides aforesaid functions according to the above embodiments are realized by executing the program codes which are read by a computer, the present invention includes a case where an OS (operating system) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

In the case where the present invention is provided in the form of the above storage medium, the storage medium stores program codes corresponding to the above mentioned timing charts.

As many apparently widely different embodiments of the present invention can be made without departing from the spirit and scope thereof, it is to be understood that the invention is not limited to the specific embodiments thereof except as defined in the appended claims.

The present invention is not limited to the above embodiments and various changes and modifications can be made within the spirit and scope of the present invention. Therefore, to apprise the public of the scope of the present invention the following claims are made.

What is claimed is:

1. A printhead which has a plurality of printing elements and drives each printing element in accordance with input printing data to perform printing, comprising:

a clock signal input terminal for externally receiving a plurality of clock signals having different frequencies;

input means for converting the printing data input in synchronism with a clock signal having a first frequency supplied to said clock signal input terminal into data corresponding to the printing elements; and output means for externally outputting information regarding the printhead in synchronism with a clock signal which is supplied to said clock signal input terminal and has a second frequency lower than the first frequency.

2. The printhead according to claim 1, further comprising control means for controlling operation states of said input means and said output means in response to a frequency of a clock signal supplied to said clock signal input terminal.

3. The printhead according to claim 1, wherein the information regarding the printhead includes a characteristic of the printing elements.

4. The printhead according to claim 1, wherein the information regarding the printhead includes an output from a sensor arranged inside the printhead, and said output means includes A/D conversion means for converting an output from the sensor into a digital signal.

5. The printhead according to claim 4, wherein the sensor comprises a temperature sensor for measuring a temperature of the printhead.

6. The printhead according to claim 4, further comprising frequency division means for frequency-dividing a clock signal supplied to said clock signal input terminal, and said output means outputs a digital signal converted by said A/D conversion means, in synchronism with a signal obtained by frequency-dividing the clock signal having the second frequency.

7. The printhead according to claim 1, wherein the printhead comprises an inkjet printing head for discharging ink to perform printing.

8. The printhead according to claim 7, wherein the printhead discharges ink using thermal energy, and comprises thermal energy transducers for generating thermal energy to be applied to the ink.

9. The printhead according to claim 1, wherein said input means comprises a shift register for receiving the printing data serially in synchronism with the clock signal having the first frequency.

10. The printhead according to claim 1, wherein said clock signal input terminal, said input means and said output means are provided on the same printing element board.

11. A printing apparatus for performing printing using a printhead which has a plurality of printing elements and drives each printing element in accordance with input printing data to perform printing, the printhead having a clock signal input terminal for externally receiving a plurality of clock signals having different frequencies, input means for converting the printing data input in synchronism with a clock signal having a first frequency supplied to the clock signal input terminal into data corresponding to the printing elements, and output means for externally outputting information regarding the printhead in synchronism with a clock signal which is supplied to the clock signal input terminal and has a second frequency lower than the first frequency, comprising:

clock signal generation means for generating clock signals having the first and second frequencies.

12. The printing apparatus according to claim 11, wherein said input means comprises a shift register for receiving the printing data serially in synchronism with the clock signal having the first frequency.

13. The printing apparatus according to claim 11, wherein said clock signal input terminal, said input means and said output means are provided on the same printing element board.

14. A control method for a printhead which has a plurality of printing elements and drives each printing element in accordance with input printing data to perform printing, comprising:

an input step of converting the printing data input in synchronism with an externally supplied clock signal having a first frequency into data corresponding to the printing elements;

an output step of externally outputting information regarding the printhead in synchronism with an externally supplied clock signal having a second frequency lower than the first frequency; and a control step of controlling operation states in the input and output steps in accordance with the frequencies of the externally supplied clock signals.

15. The method according to claim 14, wherein the output step comprises a step of reading out information as the information regarding the printhead from a nonvolatile memory storing a characteristic of the printing element.

16. The method according to claim 14, wherein the output step comprises an A/D conversion step of converting an output from a sensor arranged inside the printhead as the information regarding the printhead into a digital signal.

17. The method according to claim 16, wherein the sensor comprises a temperature sensor for measuring a temperature of the printhead.

18. The method according to claim 16, further comprising a frequency division step of frequency-dividing the externally supplied clock signal, and the output step comprises outputting a digital signal obtained in the A/D conversion step, in synchronism with a signal obtained by frequency-dividing the clock signal having the second frequency in the frequency division step.

19. The method according to claim 14, wherein said input step receives the printing data serially in synchronism with the clock signal having the first frequency.

20. The method according to claim 14, wherein the clock signals having the first and second frequencies are inputted to the same input terminal.

21. A computer program product for executing control of a printhead which has a plurality of printing elements and drives each printing element in accordance with input printing data to perform printing, comprising program codes corresponding to:

an input step of converting the printing data input in synchronism with an externally supplied clock signal having a first frequency into data corresponding to the printing elements;

an output step of externally outputting information regarding the printhead in synchronism with an externally supplied clock signal having a second frequency lower than the first frequency; and a control step of controlling operation states in the input and output steps in accordance with the frequencies of the externally supplied clock signals.

22. A computer-readable storage medium which stores a computer program for executing control of a printhead which has a plurality of printing elements and drives each printing element in accordance with input printing data to perform printing, the medium storing program codes corresponding to:

an input step of converting the printing data input in synchronism with an externally supplied clock signal having a first frequency into data corresponding to the printing elements;

an output step of externally outputting information regarding the printhead in synchronism with an externally supplied clock signal having a second frequency lower than the first frequency: and a control step of controlling operation states in the input and output steps in accordance with the frequencies of the externally supplied clock signals.

* * * * *

UNITED STATES PATENT AND TRADEMARK OFFICE

CERTIFICATE OF CORRECTION

PATENT NO. : 6,467,883 B1
DATED : October 22, 2002
INVENTOR(S) : Sakurai

It is certified that error appears in the above-identified patent and that said Letters Patent is hereby corrected as shown below:

Column 1,
Line 50, “and” (first occurrence) should read -- and output --.

Column 18,
Line 10, “b” should be deleted.
Line 11, “oiling” should read -- boiling --.

Column 20,
Line 62, “frequency:” should read -- frequency; --.

Signed and Sealed this

Twenty-third Day of December, 2003

JAMES E. ROGAN
*Director of the United States Patent and Trademark Office*